United States Patent [19]

Uke et al.

[11] Patent Number: 4,953,862

[45] Date of Patent: Sep. 4, 1990

[54] HAND GRIP FOR SPORTING EQUIPMENT OR TOOLS

[76] Inventors: Alan K. Uke, 5980 Rancho Diegueno, P.O. Box 8531, Rancho Santa Fe, Calif. 92067; Lawrence P. Monty, 54 Briar Rd., Leominster, Mass. 01453

[21] Appl. No.: 339,689

[22] Filed: Apr. 18, 1989

[51] Int. Cl.[5] ..... A63B 49/08; A63B 59/06; A63B 53/14; B25G 1/01

[52] U.S. Cl. ..... 273/75; 273/67 DB; 273/81 R; 273/81 B; 273/72 R; 81/177.1; 81/489

[58] Field of Search ..... 273/67 R, 67 DA, 67 DB, 273/73 F, 73 H, 73 J, 73 K, 75, 81 R, 81 B, 72 R, 81 D, 72 B; 81/177.1, 489

[56] References Cited

U.S. PATENT DOCUMENTS

| | | | |
|---|---|---|---|
| D. 164,241 | 8/1951 | Karns | D34/5 |
| D. 173,110 | 9/1954 | Karns | D34/5 |
| D. 174,183 | 3/1955 | Karns | D34/5 |
| D. 210,468 | 3/1968 | Brewer | D34/5 |
| 1,161,270 | 11/1915 | Vance | 81/489 |
| 1,435,088 | 11/1922 | Smith | 273/75 |
| 1,587,082 | 6/1926 | Mattern | 273/81 B |
| 2,620,001 | 12/1952 | Fratz et al. | 81/177.1 |
| 2,871,899 | 2/1959 | Coyle et al. | 273/81 R |
| 2,984,486 | 5/1961 | Jones | 273/75 |
| 3,173,462 | 3/1965 | Koeppel | 81/177.1 |
| 3,189,069 | 5/1965 | Stowell | 273/81 R |
| 3,343,577 | 9/1967 | Wagner | 81/177.1 |
| 3,606,326 | 9/1968 | Sparks et al. | 273/75 |
| 3,848,480 | 11/1974 | Oseroff et al. | 273/75 |
| 4,072,312 | 2/1978 | Kahn | 273/75 |
| 4,091,497 | 5/1978 | Bade | 16/110 R |
| 4,537,399 | 8/1985 | Adam | 273/75 |
| 4,549,736 | 10/1985 | Lofty | 273/75 X |

FOREIGN PATENT DOCUMENTS

| | | | |
|---|---|---|---|
| 7651/32 | 6/1932 | Australia | 273/81 |
| 20912 | 3/1905 | Fed. Rep. of Germany | 273/75 |

*Primary Examiner*—Benjamin Layno

*Attorney, Agent, or Firm*—Brown, Martin, Haller & McClain

[57] ABSTRACT

A hand grip for fitting on the handle shaft of a sporting implement or a tool, for example a racket or bat, comprises an elongate sleeve of elastomeric material having an internal surface for fitting over the handle shaft and an outer, gripping surface for gripping by the user's hand. The grip has indentations on at least one of its inner and outer surfaces which extend over part of the surface area to provide regions of varying softness. The softness is provided by the thinned out or indented regions bending or collapsing under load against the hand.

10 Claims, 1 Drawing Sheet

HAND GRIP FOR SPORTING EQUIPMENT OR TOOLS

BACKGROUND OF THE INVENTION

The present invention relates to a hand grip for the handle shafts of various sporting or hardware devices, such as tennis rackets, squash or racquetball rackets, baseball bats, golf clubs, and so on, or for tools such as hammers, axes and the like.

Rackets, clubs or bats used in various sports must withstand relatively high forces on impact with a ball, and have a handle shaft that is comfortably gripped by the user. The shock or impact is transmitted to the user via the handle shaft, and thus some absorption by the handle is desirable. Since the impact is steered by the handle shaft, the shock absorption should not be to the detriment of control. Also, a gripping surface is normally provided to reduce the risk of the hand slipping or releasing the handle as a result of impact. Similar impact forces are encountered in use of various tools with handle shafts, such as hammers, axes and the like.

SUMMARY OF THE INVENTION

It is an object of this invention to provide an improved hand grip for an implement having a handle shaft.

According to the present invention, a hand grip for a handle shaft is provided, which comprises an elongate sleeve of elastomeric material having an internal surface for fitting over the outer surface of a handle shaft and an outer gripping surface, the sleeve having indentations over at least part of at least one of its inner and outer surfaces, the indentations being designed to allow deflection of the surface under normal impact.

Preferably, indentations are provided over at least part of both the inner and outer surfaces, both to reduce the overall weight of the grip and to allow deflection to absorb shock and vibration. In a preferred embodiment of the invention, at least one of the inner and outer faces of the sleeve has a plurality of indentations in surface areas generally parallel to an impacting face of the implement, with fewer or no indentations on areas perpendicular to the impacting face. Thus, the grip is designed to deflect less in sideways and torque directions than in the direction of impact. This is so that the implement can be optimally positioned and oriented while still providing shock absorption. The torque or twist resistance allows better aiming or directing of the impacting force. Thus, for example, where the implement is used to hit a ball or like projectile, more control over the ball direction is provided.

The sleeve is preferably designed to resist twisting or torque, and comprises a semi solid or stiff material. Preferably, one or both of the inner and outer surfaces have two or more surface regions with either less or no indentations than the remainder of the respective surfaces. These regions preferably extend along the entire length of the grip to resist twisting of the grip. The alternating indented and non-indented areas provide a non-isotropic body with alternating harder and softer regions and also provide increased resilience or deflection in the direction of vibration or impact. The grip is more resistant to torque and perpendicular compression than to compression in the direction of impact load. This allows the user to control the implement's direction and orientation while reducing the effects of impact on the user.

The grip is preferably made from a thermoplastic rubber alloy material or equivalent thermoset elastomeric material which deflects relatively easily but has high internal damping characteristics. Since the deflection is principally on one axis, twisting of the grip is resisted. This is an advantage particularly where the grip is used for sports or on tools where the implement tends to twist on impact, which can change the desired direction of impact. The grip resists such twisting forces and allows the user to maintain orientation of the implement more easily. In sports such as tennis, this will result in more control of the ball direction on impact.

At the same time, the cut outs or indentations allow the material in certain areas of the grip to buckle or compress, absorbing impact forces more readily. The cut outs are preferably provided in at least those areas of the grip which will be subject to the most pressure on impact, so that those areas will deflect readily on impact, evening out the force and reducing the tendency for pressure blisters or calluses to form. The material is preferably designed to reduce or absorb vibrations, and preferably acts as a mechanical low pass filter, with the dampening coefficient increasing with frequency to absorb high frequency vibrations which produce the most discomfort. Appropriate elastomeric materials with the desired damping properties may be selected. The damping of high frequency vibrations will make the grip significantly more comfortable and may help avoid "tennis elbow" or similar conditions. The selected material preferably also has a slow response or rebound rate, so that it will compress quickly but rebound relatively slowly out of phase with the impact caused vibrations. The material in the preferred embodiment comprises a thermoplastic or thermoset rubber alloy with innate dampening or compounded with a suitable dampening agent.

Preferably, the indentations on at least the inner surface of the grip comprise a series of spaced elongate grooves extending along at least that part of the grip which will normally be gripped by the hand. Several separate grooved regions may be provided with regions having fewer or no grooves between adjacent grooved regions to resist twisting. The regions with less or no grooves will be in axes perpendicular to the impacting face so that the lack of deflection in these areas will provide better support. The outer surface may also be grooved or ribbed, or may be provided with a plurality of indentations across at least part of its area.

The sleeve may be of any desired cross-section according to the implement on which it is to be used. For example, it may have inner and outer surfaces of generally polygonal cross-section corresponding to the shape of handle shafts used in racket sports such as racquetball, squash and tennis, or the inner and outer surfaces may be of circular or other cross sections, for example corresponding to the shape of the handle shafts of bats or clubs used in other sports, or may conform to the shape of tool handle shafts. Where the outer surface of the sleeve is of non-round shape with edges or corners, the edges have less indentations than the flats, or no indentations at all, to provide relatively hard edges which stand out and can be used for indexing the hand position in the normal way.

The hand grip is lightweight but of relatively stiff, torque resistant material and design, and will be comfortable to use due to its compressibility at least in the areas where the highest gripping pressure is used.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 1:
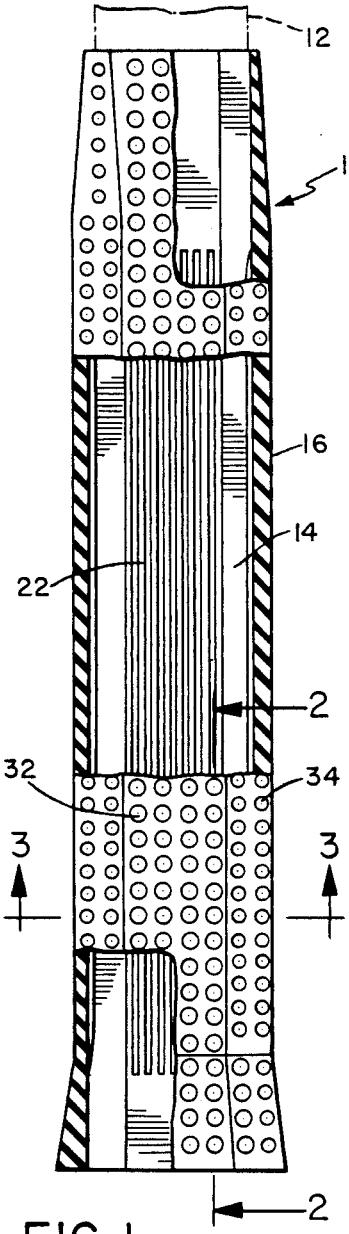
FIG. 1 is a side elevation view of the hand grip according to a preferred embodiment of the invention with portions cut away.
Figure 2:
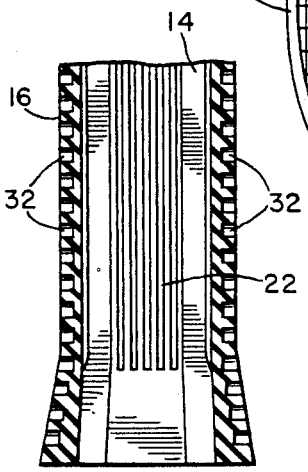
FIG. 2 is a sectional view taken on line 2—2 of FIG. 1.
Figure 5:
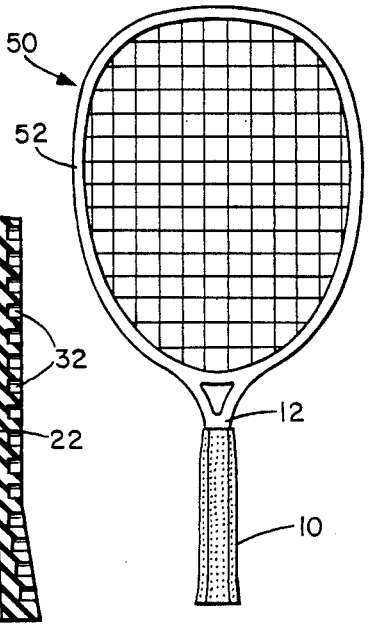
FIG. 5 is a top plan view illustrating a racket with the hand grip of FIGS. 1 to 3 mounted on the handle shaft of the racket.
Figure 3:
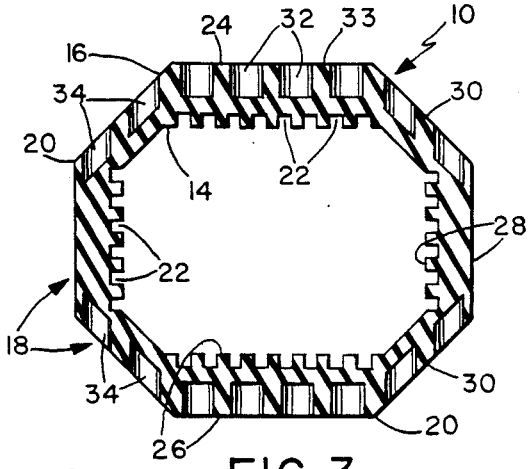
FIG. 3 is an enlarged sectional view taken on line 3—3 of FIG. 1.

FIGS. 1 to 3 illustrate a hand grip 10 according to a preferred embodiment of the invention for fitting over a handle shaft 12 of any desired implement. The hand grip illustrated in FIGS. 1 to 3 is particularly designed for fitting over the handle shaft of a racket 50 such as a tennis, badminton or racket ball racket, as illustrated in FIG. 5. However, it will be understood that similar principles may be applied in a hand grip for other types of sporting equipment and other implements, such as golf clubs, fishing rods, baseball bats, cricket bats, and the like, as well as tools such as hammers, axes, spades, and so on.

The hand grip 10 comprises a sleeve of a suitable relatively stiff but resilient or elastomeric material. Preferably, the material is not foamed or spongy, or is only slightly foamed, so that it has little or no internal air-filled cells or cavities. The sleeve structure is designed to be compressible while resisting stretching forces, so that it resists twisting on impact of the implement with a ball or other object, one made of a foam material which would not resist twisting.

The sleeve has an internal surface 14 designed to fit over the handle shaft of the implement on which it is to be mounted. Thus, the cross-section of the internal surface 14 will be suitably shaped and dimensioned for a close sliding or force fit over the outer surface of the handle shaft 12. The outer or gripping surface 16 may be of any desired shape or cross section, preferably equivalent to that of the inner surface although the two surfaces may be of different cross-section in some cases, as desired and depending on the use of the implement on which the grip is to be used.

In FIGS. 1 to 3 and 5, the sleeve is designed to slide onto the handle shaft 12 of a racket such as a racquetball, tennis or squash racket. Such rackets normally have handles of polygonal shape to provide edges for indexing. Thus, in FIGS. 1 to 3, the inner and outer surfaces 14 and 16 are of polygonal cross-section consisting of flats 18 separated by edges or corners 20. Where the sleeve is to be used on different types of handle shaft, for example those of baseball or other bats, or golf clubs, the cross-section may be round or circular as in the sleeve or grip 40 illustrated in FIG. 4. Clearly other cross-sectional shapes may be used as desired.

The outer surface will be sized to fit the grip of a user. Grips having varying outer dimensions may be provided for user's having different size hand grips. The different size grips will allow for the variation in hand size from person to person, and particularly between men, women and children.

As illustrated in FIGS. 1 to 3, the inner surface 14 has a series of indentations comprising elongate grooves 22 which extend along at least part of the length of the sleeve. Preferably, the grooves 22 terminate short of the opposite ends of the sleeve and extend only along that part of the sleeve which will normally be gripped during use of the article or implement on which the grip is used. In FIGS. 1 to 3, the outer and inner surfaces of the sleeve are of generally octagonal shape, corresponding to that of the handle of a tennis or other racket, and comprise upper and lower flats 24,26 parallel to the impact face of the racket and side flats 28 perpendicular to the impact face and separated from the upper and lower flats by narrower, diagonal flats 30. As best shown in FIGS. 3 and 5, the upper and lower flats in the case of a racket 50 are parallel to the plane of the racket head or impact face 52, in other words corresponding to those areas which will be spanned and gripped by the hand of a user and to which the impact force will be applied.

As illustrated in FIG. 3, the grooves 22 on the inner surface are provided only on the upper, lower and side flats 24,26 and 28, while no indentations are provided on the inclined diagonal flats 30. In one specific example, grooves of approximately 1 mm depth and 1 mm width were provided at 1 mm spacings across flats 24, 26 and 28. Although the indentations on the inner surface comprise spaced grooves or ribs in the preferred embodiment illustrated, other formations such as holes, ridges, slots or other shapes of indentations may be used instead of long grooves. The grooves may not be continuous as shown but could each consist of a series of groove segments. Any surface irregularity or unevenness may be used on the inner surface of the sleeve to provide compressibility in desired areas, as will be explained in more detail below.

Preferably, indentations are also provided across at least part of the outer surface 16 to reduce the weight of the grip and enhance the compressibility or softness of the grip in the desired regions parallel to the impact face. In the preferred embodiment illustrated, the indentations on the outer surface comprise a plurality of relatively deep holes 32, 34 on at least the upper and lower flats 24 and 26 and the narrow diagonal flats 30, respectively. The holes are of sufficient depth to reduce the overall weight of the sleeve significantly, which is desirable in most cases and particularly in sporting equipment. As illustrated in FIG. 3, the hole depth is equivalent to more than half the wall thickness of the sleeve, and there are sufficient holes in addition to the grooves on the inner surface to reduce the overall weight to at least about half that of a sleeve of equivalent dimensions with no cut outs or indentations on its surfaces. Thus, the holes on the flats 24, 26 and 30 cover the majority of the surface of the flats. More indentations are provided on those areas of the grip which are parallel to the impact face of the implement than on those which are perpendicular to the impact face. This provides shock absorption in the impact direction but resists twisting and sideways deflections.

In one specific example, rows of holes of approximately 3 mm diameter at about 4 mm center to center spacing were provided across flats 24, 26 and 30. The overall wall thickness of the sleeve was 5 mm, while the hole depth was around 4 mm, leaving a 1 mm wall thickness. The holes 34 in the narrow inclined flats 30 are preferably provided with their axes perpendicular to the upper and lower flats 24,26, rather than perpendicular to the surface of the inclined flat in which they are located, as can be seen in FIG. 3. This is easier to manufacture since the hole punching tool must be aligned in one orientation only.

The edges 20 between adjacent indented flats have either fewer holes than the flats or no holes at all, so that they will be harder and stand out more when the sleeve is gripped. In the illustrated embodiment, the holes 32 and 34 terminate short of the edges or corners 20 to leave them free and continuous. The edges will therefore be relatively hard, which is important in sports where such edges are used by the fingers for feel and for indexing the correct gripping position of the hand. Different hole patterns may be used to provide areas of varying softness, with softer areas corresponding to the precise hand and finger positions for a correct hand grip, for example. Although in the preferred embodiment illustrated the indentations on the outer surface comprise holes, other shapes and types of indentations may alternatively be used, such as grooves similar to those on the inner surface.

The sleeve or grip 10 has areas of varying softness, in other words it is non-isotropic or non-homogeneous, resulting from the alternating indented and non-indented regions. The softer areas are provided in those regions parallel to the impact face. These areas will be gripped by the user's hands and fingers and provide added comfort, since the sleeve in those regions will buckle or compress more readily to absorb impacts. The indentations or holes are separated by relatively narrow web portions 33 which will bend or buckle under pressure. As can be seen in FIG. 3, the width of portions 33 is less than their height so that they will buckle relatively easily. The elongate, harder areas provided by side flats 28 on the outer surface act to resist twisting of the sleeve on impact.

The internal surface of the sleeve may be secured to the selected handle shaft by an adhesive layer applied to the handle shaft prior to fitting the sleeve over the shaft. The ribbed or grooved regions on the internal surface increase the contact area with the shaft and at the same time reduce the weight and improve the compressibility of the sleeve. The elongate ribs or grooves allow the sleeve to compress inwardly relatively easily while resisting stretching or twisting forces. The ribbed or grooved area may be designed of equal or slightly smaller dimensions than the outer dimensions of the shaft over which it is fitted. If smaller, some compression of the ribs will occur as the sleeve is fitted over the shaft, providing greater adhesion and thus more resistance to movement of the sleeve on the shaft when fitted.

As discussed above, the sleeve is of an elastomeric material which compresses readily but which is resistant to stretching or twisting forces. In the preferred embodiment of the invention, a molded thermoplastic rubber material is used for the sleeve. Preferably, the material has a hardness of 40 to 90 Shore A durometer and a relatively low response time or rebound rate as compared to natural rubber. The indentations on the inner and outer surfaces provide additional resiliency or travel in the desired regions. The material may be compounded with a suitable dampening agent to increase damping of higher frequency vibrations. In other words, the grip is designed to act as a low pass filter which absorbs some or all of the higher frequency vibrations resulting from impacts. In one specific example, the material used for the sleeve was styrene butadiene rubber, which has relatively slow response or rebound time. Other equivalent rubber materials may be used. The styrene butadiene rubber may be compounded with a dampening agent such as PVC or ethyl vinyl acetate (EVA) if desired. These dampening agents have the same durometer as the overall material used but produce higher dampening properties at high frequencies.

Figure 4:
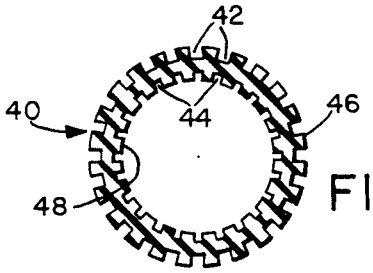
FIG. 4 is a similar sectional view illustrating an alternative circular cross section hand grip.

FIG. 4 illustrates an alternative, rounded shape for the hand grip 40 which is suitable, for example, for fitting over the cylindrical handle shafts of clubs which have no specific impact face or region, such as baseball bats. Indentations 42,44 are provided on both the outer and inner surface 46,48 of the sleeve. Indentations 42 preferably comprise holes as in FIGS. 1 to 3 while indentations 44 comprise grooves. The grip will therefore provide the desired compression or deflection on impact whichever way it is held. If desired, spaced regions with fewer or no indentations may be provided on the inner surface to resist torque or twisting.

The hand grip described above in connection with FIGS. 1 to 3 and with FIG. 4 is soft enough, at least in the areas to which gripping force is applied, to provide a comfortable grip and to absorb impact forces significantly by compressing or buckling. At the same time, the grip resists twisting or torsion as a result of the impact, improving control. The material is designed to act as a mechanical low pass filter, absorbing or significantly reducing high frequency vibrations for improved comfort to the user. Such vibrations are believed to be a factor in injuries such as tennis elbow, so this grip may help to reduce the incidence of such injuries.

The indented outer surface regions provide a better gripping surface and will buckle or compress to conform to the shape of the hand, reducing the pressure on the hand on impact and thus reducing the incidence of calluses or blisters. The non-indented areas on the outer surface correspond to those regions of the grip which will be generally perpendicular to the impact face of the implement, which may be a sporting implement or a tool such as a hammer. These regions act to stiffen the material in those areas and resist twisting and sideways deflections. The indented and non-indented regions on the inner surface have a similar purpose.

The combined effect of the material used for the grip and the holes and grooves in its outer and inner surfaces is to improve comfort while at the same time resisting twisting, absorbing shock, and reducing vibrations, particularly high frequency vibrations.

The sleeve is non-uniform or non-isotropic around its periphery where used with implements having an impact face. The sleeve has alternating indented or lesser indented regions and is more resistant to undesirable torque and sideways forces along its face than to compression. The alternating indented and non-indented regions provide areas of varying softness, with the softer regions corresponding to those areas gripped by the hand to provide comfort, better grip and comformability to the hand. The material will deflect or deform in regions where the highest pressure is applied, reducing the risk of formation of pressure blisters or calluses and evening out the force applied to the hand on impact.

The less soft regions having fewer or no indentations provide better control of the implements by resisting sideways deflections and torque. The grip is lightweight and comfortable to use.

Although a preferred embodiment of the invention has been describe above by way of example only, it will be understood by those skilled in the field that modifications may be made to the disclosed embodiment without departing from the scope of the invention, which is defined by the appended claims.

I claim:

1. A hand grip for a handle shaft, comprising:

an elongated sleeve of elastomeric material having an inner surface for fitting over the outer surface of a handle shaft and an outer, gripping surface;

at least one surface of the sleeve having a plurality of indentations, comprising holes, extending over at least part of its area to allow deflection of the surface in that area under normal impact loads;

the inner and outer surfaces being of octagonal cross-section, including upper and lower flats, and side flats separated from the upper and lower flats by diagonal flats, the indentations being provided at least on the upper and lower flats; and the outer gripping surface having indentations comprising a plurality of holes extending along the upper, lower and diagonal flats, and the side flats being at least less indented.

2. The grip as claimed in claim 1, wherein the inner surface has indentations comprising elongate grooves extending along at least part of the length of at least the upper and lower flats.

3. A hand grip for a handle shaft comprising:

an elongated sleeve of elastomeric material having an inner surface for fitting over the outer surface of a handle shaft and an outer, gripping surface;

at least one surface of the sleeve having a plurality of indentations extending over at least part of its area to allow deflection of the surface in that area under normal impact loads;

the material comprising a thermoplastic rubber alloy having a hardness in the range from 40–90 Shore A Durometer which is compounded with a dampening compound to reduce vibrations of 20 Hz and above.

4. The grip as claimed in claim 3, wherein the sleeve is of circular cross-section.

5. The grip as claimed in claim 3, wherein the rubber is styrene butadiene rubber alloy.

6. The grip as claimed in claim 3, wherein the dampening compound is selected from the group consisting of PVC and EVA.

7. A hand grip for a handle shaft, comprising:

an elongated sleeve of resilient material having an internal surface for fitting over a handle shaft and an outer gripping surface;

the sleeve having areas of varying softness extending around its periphery, with softer areas comprising at least those areas to which pressure is applied by a hand gripping the sleeve on impact;

the areas of varying hardness comprising alternating elongate regions having a greater and lesser number of indentations on at least one of the inner and outer surfaces of the sleeve; and the areas having a greater number of indentations being generally perpendicular to the impact direction.

8. The grip as claimed in claim 7, wherein the areas of varying hardness comprise alternating indented and non-indented regions.

9. The grip as claimed in claim 7, wherein the material is a thermoplastic rubber.

10. The grip as claimed in claim 7, wherein the inner surface of the sleeve has a plurality of elongate grooves extending along at least part of its length and arranged in at least two separate grooved sections separated by elongate less or non-grooved surface sections.

* * * * *